US011336008B2

(12) United States Patent
Hirabe

(10) Patent No.: US 11,336,008 B2
(45) Date of Patent: May 17, 2022

(54) CONTROL APPARATUS, OAM TRANSMISSION APPARATUS, OAM RECEPTION APPARATUS, CONTROL METHOD, NON-TRANSITORY COMPUTER-READABLE MEDIUM, AND CONTROL SYSTEM

(71) Applicant: NEC Corporation, Tokyo (JP)

(72) Inventor: Masashi Hirabe, Tokyo (JP)

(73) Assignee: NEC CORPORATION, Tokyo (JP)

( * ) Notice: Subject to any disclaimer, the term of this patent is extended or adjusted under 35 U.S.C. 154(b) by 0 days.

(21) Appl. No.: 17/263,754

(22) PCT Filed: Jul. 18, 2019

(86) PCT No.: PCT/JP2019/028212
§ 371 (c)(1),
(2) Date: Jan. 27, 2021

(87) PCT Pub. No.: WO2020/026827
PCT Pub. Date: Feb. 6, 2020

(65) Prior Publication Data

US 2021/0167495 A1 Jun. 3, 2021

(30) Foreign Application Priority Data

Aug. 2, 2018 (JP) ..... JP2018-146300

(51) Int. Cl.
*H01Q 3/18* (2006.01)
*H01Q 3/20* (2006.01)
*H01Q 3/16* (2006.01)

(52) U.S. Cl.
CPC ..... *H01Q 3/18* (2013.01); *H01Q 3/16* (2013.01); *H01Q 3/20* (2013.01)

(58) Field of Classification Search
CPC .. H01Q 3/16; H01Q 3/18; H01Q 3/20; H01Q 15/147; H01Q 15/148
See application file for complete search history.

(56) References Cited

U.S. PATENT DOCUMENTS 5,351,060 A * 9/1994 Bayne ..... H01Q 1/1257 342/359
6,031,502 A * 2/2000 Ramanujam ..... H01Q 1/18 343/761

(Continued)

FOREIGN PATENT DOCUMENTS

JP H05-160622 A 6/1993
JP 2016-021744 A 2/2016

(Continued)

OTHER PUBLICATIONS

International Search Report for PCT Application No. PCT/JP2019/028212, dated Oct. 21, 2019.

(Continued)

*Primary Examiner* — AB Salam Alkassim, Jr.
(74) *Attorney, Agent, or Firm* — Sughrue Mion, PLLC

(57) ABSTRACT

In a transmitting-side control apparatus (30), a transmission control unit (32) controls a radiator (11) to transmit an OAM known signal formed by one common OAM transmission mode at each of transmitting-side relative position candidates. An acquisition unit (33) acquires a feedback signal including information about a use transmitting-side relative position based on a reception strength of the OAM known signal transmitted under the control of the transmission control unit (32). An adjustment unit (34) adjusts a relative position between the radiator (11) and a focal point of a reflecting mirror (12) to the use transmitting-side relative position indicated by the information included in the feedback signal.

6 Claims, 6 Drawing Sheets

(56) References Cited

U.S. PATENT DOCUMENTS

| | | | | |
|---|---|---|---|---|
| 9,031,151 | B1 * | 5/2015 | Harris | H04B 7/0617 375/267 |
| 9,350,084 | B1 * | 5/2016 | Harris | H01Q 3/20 |
| 9,634,399 | B1 * | 4/2017 | Harris | H01Q 19/13 |
| 10,761,014 | B2 * | 9/2020 | Cvijetic | G01S 7/4814 |
| 2014/0333491 | A1 * | 11/2014 | Behroozi | H01Q 3/16 343/706 |
| 2015/0091756 | A1 * | 4/2015 | Casciato | H01Q 3/20 342/377 |
| 2015/0138018 | A1 * | 5/2015 | Yamamoto | H01Q 19/17 342/372 |
| 2015/0194735 | A1 * | 7/2015 | Graceffo | H01Q 19/13 343/836 |
| 2015/0263422 | A1 * | 9/2015 | Lv | H01Q 25/007 343/761 |
| 2015/0372398 | A1 * | 12/2015 | Dudorov | H01Q 19/062 342/368 |
| 2016/0028163 | A1 * | 1/2016 | Li | H01Q 19/17 343/836 |
| 2016/0315395 | A1 * | 10/2016 | Byun | H01Q 19/19 |
| 2017/0093606 | A1 * | 3/2017 | Dutronc | H04L 27/2601 |
| 2017/0331543 | A1 * | 11/2017 | Hirabe | H04B 7/02 |
| 2018/0287263 | A1 * | 10/2018 | Hirabe | H01Q 15/22 |
| 2018/0331431 | A1 * | 11/2018 | Lee | H01Q 19/191 |
| 2019/0028165 | A1 * | 1/2019 | Adachi | H01Q 19/17 |
| 2019/0252794 | A1 * | 8/2019 | Saito | H01Q 21/06 |
| 2020/0296599 | A1 * | 9/2020 | Sasaki | H04B 7/0469 |
| 2021/0028560 | A1 * | 1/2021 | Zenkyu | H01Q 21/245 |
| 2021/0167495 | A1 * | 6/2021 | Hirabe | H01Q 3/16 |
| 2021/0211168 | A1 * | 7/2021 | Sasaki | H04L 27/20 |

FOREIGN PATENT DOCUMENTS

| | | | |
|---|---|---|---|
| KR | 10-2016-0091762 | A | 8/2016 |
| WO | 2014/104911 | A1 | 7/2014 |
| WO | 2017/056136 | A1 | 4/2017 |

OTHER PUBLICATIONS

Ove Edfors et al., "Is Orbital Angular Momentum (OAM) Based Radio Communication an Unexploited Area?", IEEE Transactions on Antennas and Propagation, Feb. 2012, vol. 60, Issue: 2, pp. 1126-1131.

Hui Tian et al., "Beam axis detection and alignment for uniform circular array-based orbital angular momentum wireless communication ", IET Communications, vol. 10, Issue : 1,14 2016, IET, Feb. 1, 2016, pp. 44-49.

Japanese Office Communication for JP Application No. 2020-533416 dated Mar. 29, 2022 with English Translation.

Haogang Wang et al., "An annular parabolic trough reflector array for orbital angular momentum beam focusing", 2016 IEEE International Conference on Computational Electromagnetics (ICCEM), Oct. 13, 2016.

* cited by examiner

CONTROL APPARATUS, OAM TRANSMISSION APPARATUS, OAM RECEPTION APPARATUS, CONTROL METHOD, NON-TRANSITORY COMPUTER-READABLE MEDIUM, AND CONTROL SYSTEM

This application is a National Stage Entry of PCT/JP2019/028212 filed on Jul. 18, 2019, which claims priority from Japanese Patent Application 2018-146300 filed on Aug. 2, 2018, the contents of all of which are incorporated herein by reference, in their entirety.

TECHNICAL FIELD

The present disclosure relates to a control apparatus, an OAM transmission apparatus, an OAM reception apparatus, a control method, and a control system.

BACKGROUND ART

For the purpose of improving transmission efficiency, a technique for adjusting directions of a transmitting-side antenna and a receiving-side antenna has been proposed (e.g., Patent Literature 1). The antenna disclosed in Patent Literature 1 has a radiator and a reflecting mirror for reflecting radio waves emitted from the radiator. In the technique disclosed in Patent Literature 1, in order to adjust the direction, the position of the radiator is made closer to the reflecting mirror than a focal position of the reflecting mirror so that the directivity becomes low, and then the direction is adjusted. After the direction is adjusted, the position of the radiator is returned to the focal position.

CITATION LIST

Patent Literature

Patent Literature 1: Japanese Unexamined Patent Application Publication No. H05-160622

SUMMARY OF INVENTION

Technical Problem

Recently, a radio transmission system using electromagnetic waves having Orbital Angular Momentum (OAM), namely the OAM transmission system, has attracted attention.

The present inventor has found that there is a possibility that the transmission efficiency of the OAM transmission may not be improved by the technique disclosed in Patent Literature 1.

Specifically, since the OAM electromagnetic wave emitted from the OAM transmission apparatus rapidly spreads in a far field, there is a possibility that the transmission efficiency cannot be improved even if the directions of the transmitting-side antenna and the receiving-side antenna are adjusted depending on a distance between the OAM transmission apparatus and the OAM reception apparatus.

An object of the present disclosure is to provide a control apparatus, an OAM transmission apparatus, an OAM reception apparatus, a control method, and a control system that can improve transmission efficiency of OAM transmission.

Solution to Problem

A first example aspect is a control apparatus for controlling an Orbitral Angular Momentum (OAM) transmission apparatus including a radiator configured to be able to emit an OAM radio signal and a transmitting-side reflecting mirror configured to reflect the OAM radio signal emitted from the radiator toward an OAM reception apparatus. The control apparatus includes: a change unit configured to sequentially change a relative position between the radiator and a focal point of the transmitting-side reflecting mirror among a plurality of transmitting-side relative position candidates; a transmission control unit configured to control the radiator to transmit an OAM known signal formed by one common OAM transmission mode at each of the plurality of transmitting-side relative position candidates; an acquisition unit configured to acquire a feedback signal including information about a use transmitting-side relative position based on a reception quality of the OAM known signal transmitted under the control of the transmission control unit; and an adjustment unit configured to adjust the relative position between the radiator and the focal point of the transmitting-side reflecting mirror to the use transmitting-side relative position indicated by the information included in the feedback signal.

A second example aspect is a control apparatus for controlling an OAM reception apparatus including a receiving-side reflecting mirror and a radio receiver, the receiving-side reflecting mirror being configured to reflect an OAM radio signal emitted from a radiator in an OAM transmission apparatus including the radiator and a transmitting-side reflecting mirror, reflected by the transmitting-side reflecting mirror, and transmitted from the OAM transmission apparatus, and the radio receiver being configured to receive the OAM radio signal reflected by the receiving-side reflecting mirror. The controlling apparatus includes: a reception control unit configured to control the radio receiver to receive, in an OAM reception mode corresponding to one common OAM transmission mode, an OAM known signal transmitted from the OAM transmission apparatus at each of transmitting-side relative position candidates between the radiator and a focal point of the transmitting-side reflecting mirror using the one common OAM transmission mode; a determination unit configured to determine, as a use transmitting-side relative position, the transmitting-side relative position candidate corresponding to a best reception quality among a plurality of reception qualities measured for a plurality of the OAM known signals received by the radio receiver; and a feedback signal transmission unit configured to transmit a feedback signal including information about the determined use transmitting-side relative position.

A third example aspect is a control method for adjusting a relative position between a radiator and a focal point of a transmitting-side reflecting mirror in an OAM transmission apparatus including the radiator configured to be able to emit an OAM radio signal and the transmitting-side reflecting mirror configured to reflect the OAM radio signal emitted from the radiator toward an OAM reception apparatus. The control method includes: sequentially changing a relative position between the radiator and a focal point of the transmitting-side reflecting mirror among a plurality of transmitting-side relative position candidates; controlling the radiator to transmit an OAM known signal formed by one common OAM transmission mode at each of the plurality of transmitting-side relative position candidates; acquiring a feedback signal including information about a use transmitting-side relative position based on a reception quality of the transmitted OAM radio signal; and adjusting the relative position between the radiator and the focal point of the transmitting-side reflecting mirror to the use transmitting-side relative position indicated by the information included in the feedback signal.

A fourth example aspect of a control method for adjusting a relative position between a radiator and a focal point of a transmitting-side reflecting mirror in an OAM transmission apparatus including the radiator configured to be able to emit an OAM radio signal and the transmitting-side reflecting mirror configured to reflect the OAM radio signal emitted from the radiator toward an OAM reception apparatus. The OAM reception apparatus includes a receiving-side reflecting mirror and a radio receiver, the receiving-side reflecting mirror being configured to reflect the OAM radio signal transmitted from the OAM transmission apparatus, and the radio receiver being configured to receive the OAM radio signal reflected by the receiving-side reflecting mirror. The control method includes: controlling the radio receiver to receive, in an OAM reception mode corresponding to one common OAM transmission mode, an OAM known signal transmitted from the OAM transmission apparatus at each of transmitting-side relative position candidates between the radiator and a focal point of the transmitting-side reflecting mirror using the one common OAM transmission mode; determining, as a use transmitting-side relative position, the transmitting-side relative position candidate corresponding to a best reception quality among a plurality of reception qualities measured for a plurality of the OAM known signals received by the radio receiver; and transmitting a feedback signal including information about the determined use transmitting-side relative position.

A fifth example aspect is a control system for controlling an OAM transmission apparatus including a radiator configured to be able to emit an OAM radio signal and a transmitting-side reflecting mirror configured to reflect the OAM radio signal emitted from the radiator toward an OAM reception apparatus and an OAM reception apparatus including a receiving-side reflecting mirror configured to reflect the OAM radio signal reflected by the transmitting-side reflecting mirror and a radio receiver configured to receive the OAM radio signal reflected by the receiving-side reflecting mirror. The control system includes: a first change unit configured to sequentially change a relative position between the radiator and a focal point of the transmitting-side reflecting mirror among a plurality of transmitting-side relative position candidates; a transmission control unit configured to control the radiator to transmit an OAM known signal formed by one common OAM transmission mode at each of the plurality of transmitting-side relative position candidates; a second change unit configured to sequentially change a relative position between the radio receiver and a focal point of the receiving-side reflecting mirror among a plurality of receiving-side relative position candidates while the OAM known signal is being transmitted from the radiator at each of the transmitting-side relative position candidates; a reception control unit configured to control the radio receiver to receive the transmitted OAM known signal in an OAM reception mode corresponding to the one common OAM transmission mode; a determination unit configured to determine, as a use transmitting-side relative position and a use receiving-side relative position, the receiving-side relative position candidate and the transmitting-side relative position candidate, respectively, which constitute a combination corresponding to a best reception quality among a plurality of reception qualities, a plurality of the OAM known signals corresponding to a plurality of the combinations, each combination including one of the plurality of transmitting-side relative position candidates and one of the plurality of receiving-side relative position candidates, and the plurality of OAM known signals being received by the radio receiver; a first adjustment unit configured to adjust the relative position between the radiator and the focal point of the transmitting-side reflecting mirror to the use receiving-side relative position; and a second adjustment unit configured to adjust the relative position between the radio receiver and the focal position of the receiving-side reflecting mirror to the use receiving-side relative position.

Advantageous Effects of Invention

The present disclosure provides a control apparatus, an OAM transmission apparatus, an OAM reception apparatus, a control method, and a control system that can improve transmission efficiency of OAM transmission.

DESCRIPTION OF EMBODIMENTS

Hereinafter, example embodiments will be described with reference to the drawings. In the example embodiments, the same or equivalent elements are denoted by the same reference signs, and the repeated description is omitted.

First Example Embodiment

<Overview of Communication System>

Figure 1:
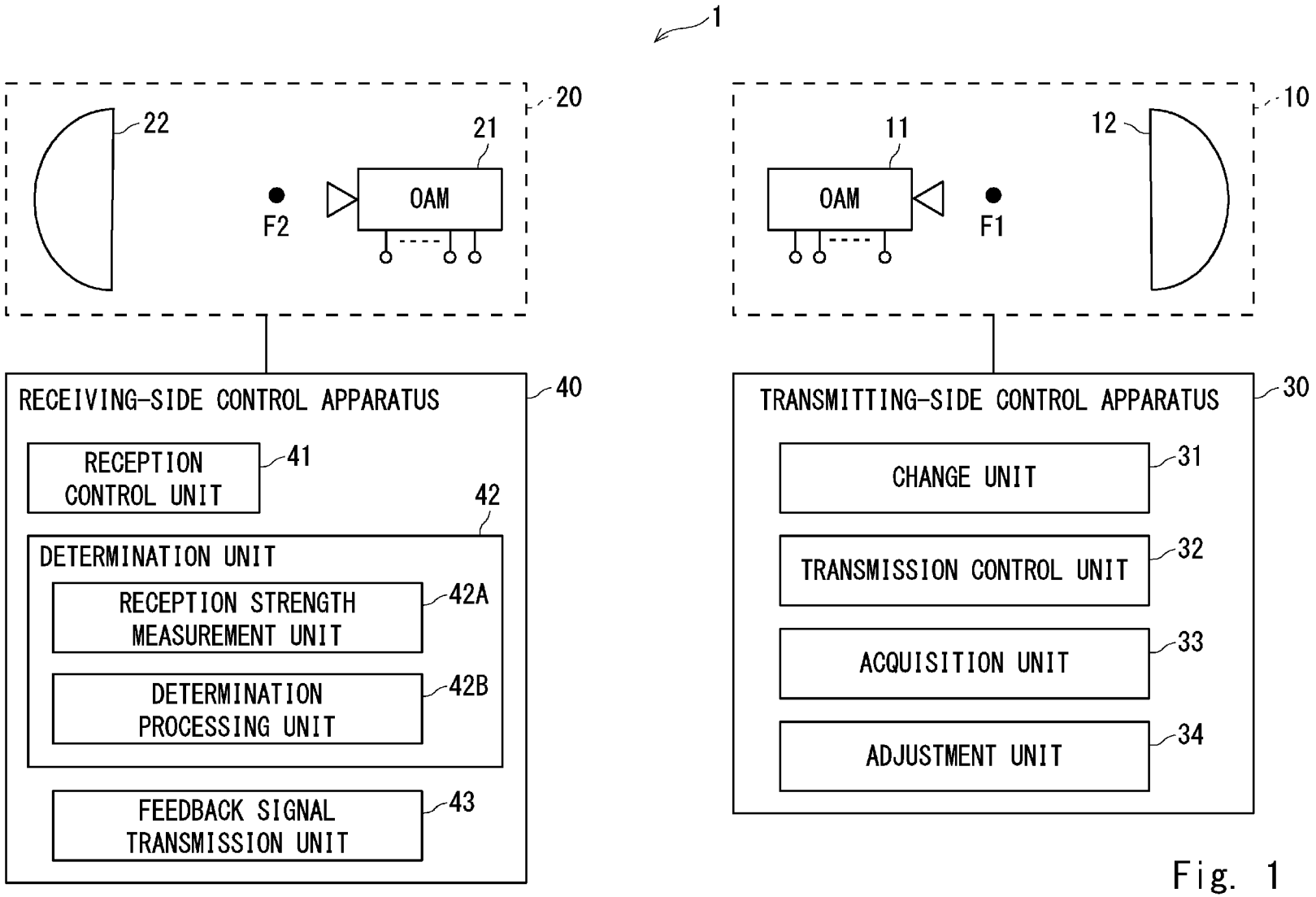
FIG. 1 shows an example of a communication system according to a first example embodiment.

FIG. 1 shows an example of a communication system according to the first example embodiment. In FIG. 1, a communication system 1 includes an OAM transmission apparatus 10, an OAM reception apparatus 20, a transmitting-side control apparatus 30, and a receiving-side control apparatus 40.

The OAM transmission apparatus 10 is configured to be able to transmit, as an OAM radio signal, an "OAM mode multiplexed radio signal" obtained by multiplexing a plurality of data signals corresponding to a plurality of OAM transmission modes, respectively. The OAM transmission apparatus 10 is configured to be able to also transmit, as an OAM radio signal", "OAM known signal" formed by one OAM transmission mode.

For example, the OAM transmission apparatus 10 includes a radiator 11 and a reflecting mirror (a transmitting-side reflecting mirror) 12. The radiator 11 emits the OAM radio signal toward the reflecting mirror 12. The reflecting mirror 12 reflects the OAM radio signal emitted from the radiator 11. The reflected OAM radio signal propagates in the direction in which the OAM reception apparatus 20 is located.

The OAM transmission apparatus 10 is configured in such a way that the relative positional relationship between the radiator 11 and a focal point F1 of the reflecting mirror 12 can be changed under the control of the transmitting-side control apparatus 30. For example, the relative positional relationship between the radiator 11 and the focal point F1 of the reflecting mirror 12 may be changed by using a driving unit (not shown) of the OAM transmission apparatus 10. The driving unit can move at least one of the radiator 11 and the reflecting mirror 12. In this case, the reflecting mirror 12 has a paraboloid of revolution like a reflecting mirror of a parabolic antenna. Alternatively, the relative positional relationship between the radiator 11 and the focal point F1 of the reflecting mirror 12 may be changed by using a reflection member (not shown) included in the reflecting mirror 12 configured to change the focal position electrically.

The OAM reception apparatus 20 is configured to be able to receive the OAM mode multiplexed radio signal transmitted from the OAM transmission apparatus 10, and execute a process for separating the received OAM multiplexed radio signal into a plurality of original data signals. The OAM reception apparatus 20 is configured to be able to execute a process of receiving the OAM known signal transmitted from the OAM transmission apparatus 10 in an OAM reception mode corresponding to the one OAM transmission mode used when the OAM known signal is formed.

For example, the OAM reception apparatus 20 includes a receiver (a radio receiver) 21 and a reflecting mirror (receiving-side reflecting mirror) 22. The reflecting mirror 22 reflects the OAM radio signal transmitted from the OAM transmission apparatus 10 toward the receiver 21. The reflecting mirror 22 has a paraboloid of revolution, for example, like a reflecting mirror of a parabolic antenna. The receiver 21 receives the OAM radio signal reflected by the reflecting mirror 22.

In the first example embodiment, the transmitting-side control apparatus 30 and the receiving-side control apparatus 40 adjust the relative positional relationship between the radiator 11 and the focal point of the reflecting mirror 12. Details will be described later.

<Configuration Example of Transmitting-Side Control Apparatus>

As shown in FIG. 1, the transmitting-side control apparatus 30 includes a change unit 31, a transmission control unit 32, an acquisition unit 33, and an adjustment unit 34.

The change unit 31 executes control for sequentially changing the relative position between the radiator 11 and the focal point of the reflecting mirror 12 among "a plurality of transmitting-side relative position candidates". For example, the "plurality of transmitting-side relative position candidates" include a plurality of relative positions between the radiator 11 and the focal point of the reflecting mirror 12, in which the plurality of relative positions have relative relationships different from each other on a straight line connecting a central point of the reflecting mirror 12 to the focal point of the reflecting mirror 12. Further, the "plurality of transmitting-side relative position candidates" may include a plurality of relative positions between the radiator 11 and the focal point of the reflecting mirror 12, in which the plurality of relative positions have relative relationships different from each other in a direction parallel to a plane orthogonal to the straight line connecting the central point of the reflecting mirror 12 to the focal point of the reflecting mirror 12.

The transmission control unit 32 controls the radiator 11 to transmit the "OAM known signal" formed by "one common OAM transmission mode" at each of the "transmitting-side relative position candidates". For example, the "one common OAM transmission mode" is an (highest order) OAM transmission mode having the highest order of a mode among the plurality of OAM transmission modes used when the "OAM mode multiplexed radio signal" is formed. Specifically, when the OAM transmission modes of mode 0, mode +1, mode −1, mode +2, and mode −2 are used to form the OAM mode multiplexed radio signals, the OAM transmission mode having the highest order of a mode is the mode +2 and the mode −2, in which the order of the mode is the second order. Thus, the "one common OAM transmission mode" is the OAM transmission mode of the mode +2 or the mode −2. It is needless to say that when the OAM transmission modes of the mode 0, mode +1, and mode −1 are used to form the OAM mode multiplexed radio signals, the OAM transmission mode with the highest order of a mode is mode +1 and mode −1, in which the order of the mode is the first order. Thus, the "one common OAM transmission mode" is the OAM transmission mode of the mode +1 or mode −1.

The acquisition unit 33 acquires a "feedback signal" including information about a "use transmitting-side relative position" based on the reception strength of the OAM known signal transmitted under the control of the transmission control unit 32.

The adjustment unit 34 adjusts the relative position between the radiator 11 and the focal point F1 of the reflecting mirror 12 to the "use transmitting-side relative position" indicated by the information included in the "feedback signal". After this adjustment, the OAM transmission apparatus 10 transmits the "OAM mode multiplexed radio signal". Thus, the transmission efficiency of the OAM transmission can be improved.

<Configuration Example of Receiving-Side Control Apparatus>

As shown in FIG. 1, the receiving-side control apparatus 40 includes a reception control unit 41, a determination unit 42, and a feedback signal transmission unit 43.

The reception control unit 41 controls the receiver 21 to receive, in the OAM reception mode corresponding to the one OAM transmission mode, the OAM known signal transmitted from the OAM transmission apparatus 10 using the one OAM transmission mode. That is, the "OAM reception mode corresponding to the one OAM transmission mode" is an OAM reception mode corresponding to an OAM transmission mode having the highest order of a mode among the plurality of OAM transmission modes used when the OAM transmission apparatus 10 forms the "OAM mode multiplexed radio signal".

The determination unit 42 determines, as the "use transmitting-side relative position candidate", the transmitting-side relative position candidate corresponding to the maximum reception strength among the plurality of reception strengths (e.g., Received Signal Strength Indicator (RSSI)) measured for a plurality of the OAM known signals received by the receiver 21. The plurality of OAM reception signals received by the receiver 21 correspond to the "plurality of transmitting-side relative position candidates", respectively.

For example, the determination unit 42 includes a reception strength measurement unit 42A and a determination processing unit 42B. The reception strength measurement unit 42A measures the reception strength of the OAM known signal received by the receiver 21. The determination processing unit 42B determines, as the "use transmitting-side relative position candidate", the transmitting-side relative position candidate corresponding to the maximum reception strength among the plurality of reception strengths (e.g., RSSI) measured by the reception strength measurement unit 42A.

Here, for example, when the transmitting-side control apparatus 30 and the receiving-side control apparatus 40 share the timing at which the OAM known signal is transmitted from each of the transmitting-side relative position candidates, the determination unit 42 specifies a reception timing or a reception order of the OAM known signals corresponding to the maximum reception strength. Thus, the transmitting-side relative position candidate corresponding to the maximum reception strength can be determined as the "use transmitting-side relative position".

The feedback signal transmission unit 43 transmits the feedback signal including information about the use transmitting-side relative position determined by the determination unit 42. For example, the feedback signal transmission unit 43 transmits the feedback signal including information about the reception timing or the reception order of the OAM known signal corresponding to the maximum reception strength specified by the determination unit 42.

As described above, according to the first example embodiment, in the transmitting-side control apparatus 30, the change unit 31 executes control for sequentially changing the relative position between the radiator 11 and the focal point of the reflecting mirror 12 among the "plurality of transmitting-side relative position candidates". The transmission control unit 32 controls the radiator 11 to transmit the "OAM known signal" formed by the "one common OAM transmission mode" at each of the "transmitting-side relative position candidates". The acquisition unit 33 acquires the "feedback signal" including the information about the "use transmitting-side relative position" based on the reception strength of the OAM known signal transmitted under the control of the transmission control unit 32. The adjustment unit 34 adjusts the relative position between the radiator 11 and the focal point F1 of the reflecting mirror 12 to the "use transmitting-side relative position" indicated by the information included in the "feedback signal".

With such a configuration of the transmitting-side control apparatus 30, the relative position between the radiator 11 and the focal point of the reflecting mirror 12 used for the OAM mode multiplex transmission can be adjusted based on the reception strength of the OAM known signal transmitted at each of the plurality of transmitting-side relative position candidates. Thus, the transmission efficiency of the OAM transmission can be improved.

Further, the transmission control unit 32 sets, as the "one common OAM transmission mode", an (highest order) OAM transmission mode having the highest order of a mode among the plurality of OAM transmission modes used when the OAM transmission apparatus 10 forms the "OAM mode multiplexed radio signal".

With such a configuration of the transmitting-side control apparatus 30, the relative position between the radiator 11 and the focal point F1 of the reflecting mirror 12 can be adjusted using the OAM transmission mode in which the degree of spread of the OAM electromagnetic wave in the far field is the largest among the plurality of OAM transmission modes. By doing so, the relative position between the radiator 11 and the focal point F1 of the reflecting mirror 12, which is favorable for the OAM transmission modes other than the highest order OAM transmission mode among the plurality of OAM transmission modes, can be reliably adjusted. Thus, transmission efficiency of the OAM transmission can be further improved.

In the receiving-side control apparatus 40, the reception control unit 41 controls the receiver 21 to receive, in the OAM reception mode corresponding to the one OAM transmission mode, the OAM known signal transmitted from the OAM transmission apparatus 10 using the one OAM transmission mode. The determination unit 42 determines, as the "use transmitting-side relative position", the transmitting-side relative position candidate corresponding to the maximum reception strength among the plurality of reception strengths measured for the plurality of OAM known signals received by the receiver 21. The plurality of OAM reception signals received by the receiver 21 correspond to the "plurality of transmitting-side relative position candidates", respectively.

With such a configuration of the receiving-side control apparatus 40, the relative position between the radiator 11 and the focal point of the reflecting mirror 12 used for the OAM mode multiplex transmission can be determined based on the reception strength of the OAM known signal transmitted at each of the plurality of transmitting-side relative position candidates. Thus, the transmission efficiency of the OAM transmission can be improved.

The "OAM reception mode corresponding to the one OAM transmission mode" is an OAM reception mode corresponding to the OAM transmission mode having the highest order of a mode (i.e., the highest order OAM transmission mode) among the plurality of OAM transmission modes used when the OAM transmission apparatus 10 forms the "OAM mode multiplexed radio signal".

With such a configuration of the receiving-side control apparatus 40, the relative position between the radiator 11 and the focal point F1 of the reflecting mirror 12 can be determined using the OAM transmission mode in which the degree of spread of the OAM electromagnetic wave in the far field is the largest among the plurality of OAM transmission modes. By doing so, the relative position between the radiator 11 and the focal point F1 of the reflecting mirror 12, which is favorable for the OAM transmission modes other than the highest order OAM transmission mode among the plurality of OAM transmission modes, can be reliably determined. Thus, the transmission efficiency of the OAM transmission can be further improved.

In the above description, although the reception strength is used as an index for determining the "use transmitting-side relative position", this is an example of an "index of reception quality" and is not limited to this.

Second Example Embodiment

In a second example embodiment, the relative positional relationship between the receiver and the focal point of the reflecting mirror can be changed also in the OAM reception apparatus. Then, the receiving-side control apparatus sequentially changes the relative position between the receiver and the focal point of the reflecting mirror among the plurality of receiving-side relative position candidates.

<Overview of Communication System>

Figure 2:
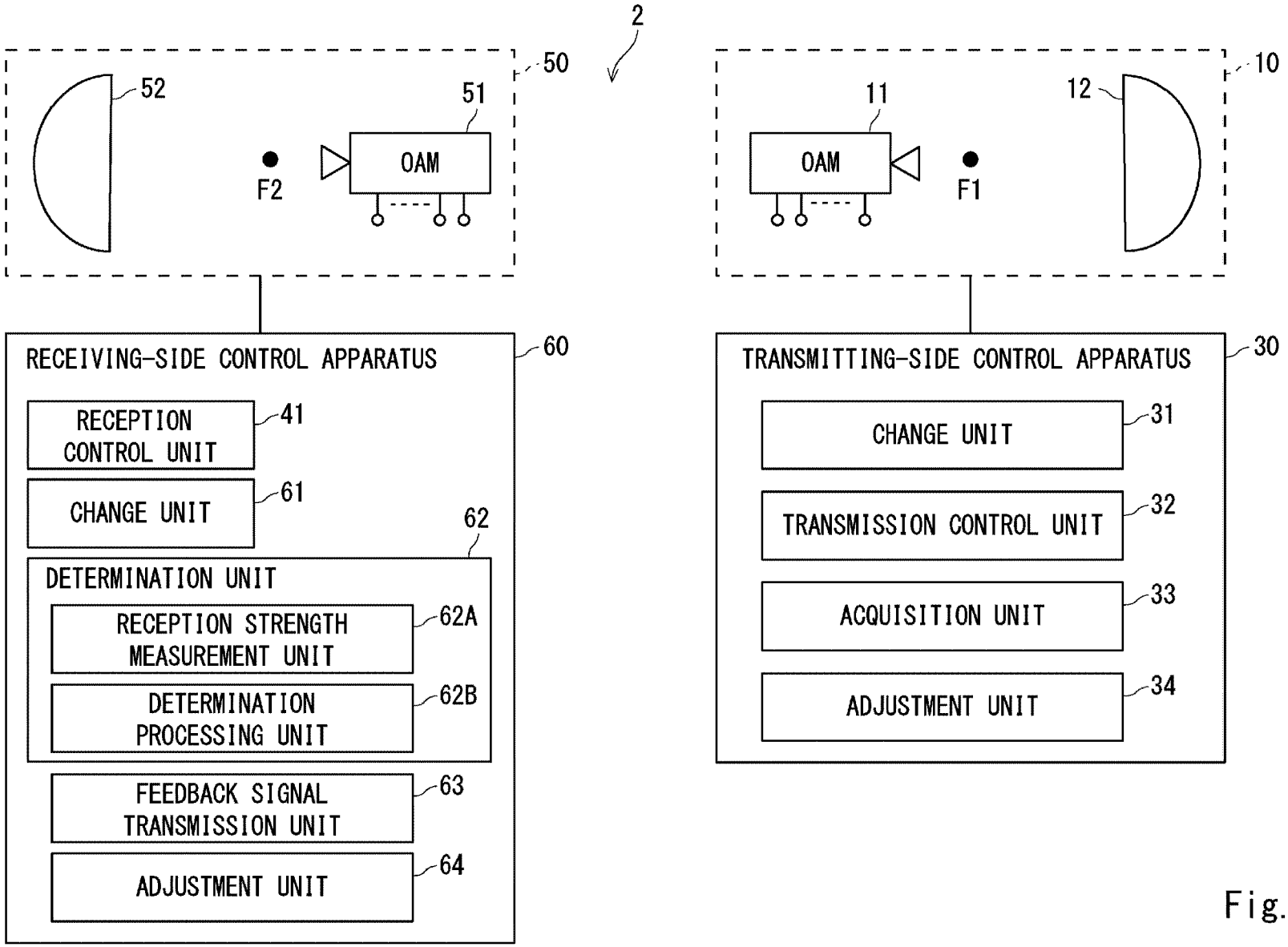
FIG. 2 shows an example of a communication system according to a second example embodiment.

FIG. 2 shows an example of the communication system according to the second example embodiment. In FIG. 2, a communication system 2 includes the OAM transmission apparatus 10, the transmitting-side control apparatus 30, an OAM reception apparatus 50, and a receiving-side control apparatus 60.

The OAM reception apparatus 50, like the OAM reception apparatus 20 according to the first example embodiment, is configured to be able to receive the OAM mode multiplexed radio signal transmitted from the OAM transmission apparatus 10, and execute a process for separating the received OAM multiplexed radio signal into a plurality of original data signals. The OAM reception apparatus 50 is configured to be able to execute a process of receiving the OAM known signal transmitted from the OAM transmission apparatus 10 in the OAM reception mode corresponding to the one OAM transmission mode used when the OAM known signal is formed.

The OAM reception apparatus 50 includes a receiver (a radio receiver) 51 and a reflecting mirror (a receiving-side reflecting mirror) 52. The reflecting mirror 52 reflects the OAM radio signal transmitted from the OAM transmission apparatus 10 toward the receiver 51. The receiver 51 receives the OAM radio signal reflected by the reflecting mirror 52.

Further, the OAM reception apparatus 50 is configured in such a way that the relative positional relationship between the receiver 51 and a focal point F2 of the reflecting mirror 52 can be changed under the control of the receiving-side control apparatus 60. For example, the relative positional relationship between the receiver 51 and the focal point F2 of the reflecting mirror 52 may be changed by using a driving unit (not shown) that can move at least one of the receiver 51 and the reflecting mirror 52. In this case, the reflecting mirror 52 has a paraboloid of revolution like a reflecting mirror of a parabolic antenna. Alternatively, the relative positional relationship between the receiver 51 and the focal point F2 of the reflecting mirror 52 may be changed by using a reflection member (not shown) included in the reflecting mirror 52 configured to change the focal position electrically.

In the second example embodiment, the transmitting-side control apparatus 30 and the receiving-side control apparatus 60 adjust the relative positional relationship between the radiator 11 and the focal point of the reflecting mirror 12, and the relative positional relationship between the receiver 51 and the focal point of the reflecting mirror 52. Details will be described later.

<Configuration Example of Receiving-Side Control Apparatus>

As shown in FIG. 2, the receiving-side control apparatus 60 includes the reception control unit 41, a change unit 61, a determination unit 62, a feedback signal transmission unit 63, and an adjustment unit 64.

In a manner similar to the first example embodiment, the reception control unit 41 according to the second example embodiment controls the receiver 51 to receive, in the OAM reception mode corresponding to the one OAM transmission mode, the OAM known signal transmitted from the OAM transmission apparatus 10 using the one OAM transmission mode.

While the OAM known signal is being transmitted at each "transmitting-side relative position candidate", the change unit 61 sequentially changes the relative position between the receiver 51 and the focal point F2 of the reflecting mirror 52 among the "plurality of receiving-side relative position candidates". The "plurality of receiving-side relative position candidates" include a plurality of relative positions between the receiver 51 and the focal point of the reflecting mirror 52, in which the plurality of relative positions have relative relationships different from each other on a straight line connecting a central point of the reflecting mirror 52 to the focal point of the reflecting mirror 52. Further, the "plurality of receiving-side relative position candidates" may include a plurality of relative positions between the receiver 51 and the focal point of the reflecting mirror 52, in which the plurality of relative positions have relative relationships different from each other in a direction parallel to a plane orthogonal to the straight line connecting the central point of the reflecting mirror 52 to the focal point of the reflecting mirror 52.

Here, for example, when there are ten transmitting-side relative position candidates and ten receiving-side relative position candidates, the ten receiving-side relative position candidates are sequentially switched while the OAM known signals are transmitted at one transmitting-side relative position candidate. Therefore, the OAM known signal is transmitted and received in 100 "combinations", which are combinations of one of the ten transmitting-side relative position candidates and one of the ten receiving-side relative position candidates. Hereinafter, the combination of the transmitting-side relative position candidate and the receiving-side relative position candidate may be referred to simply as a "pair (combination)".

The determination unit 62 determines, as the use transmitting-side relative position and the use receiving-side relative position, the transmitting-side relative position candidate and the receiving-side relative position candidate, respectively, which constitute a pair corresponding to the maximum reception strength among the plurality of reception strengths measured for the plurality of OAM known signals received by the receiver 51. The plurality of OAM known signals received by the receiver 51 correspond to the plurality of "pairs", respectively.

For example, the determination unit 62 includes a reception strength measurement unit 62A and a determination processing unit 62B. The reception strength measurement unit 62A measures the reception strength of each of the plurality of OAM known signals corresponding to each of the plurality of "pair" and received by the receiver 51. The determination processing unit 62B determines, as the "use transmitting-side relative position" and the "use receiving-side relative position", the transmitting-side relative position candidate and the receiving-side relative position candidate, respectively, which constitute a pair corresponding to the maximum reception strength among the plurality of reception strengths measured by the reception strength measurement unit 62A.

Like the feedback signal transmission unit 43 according to the first example embodiment, the feedback signal transmission unit 63 transmits the feedback signal including information about the use transmitting-side relative position determined by the determination unit 62.

The adjustment unit 64 adjusts the relative position between the receiver 51 and the focal point F2 of the reflecting mirror 52 to the "use receiving-side relative position" determined by the determination unit 62.

<Operation Example of Transmitting-Side Control Apparatus and Receiving-Side Control Apparatus>

Figure 3:
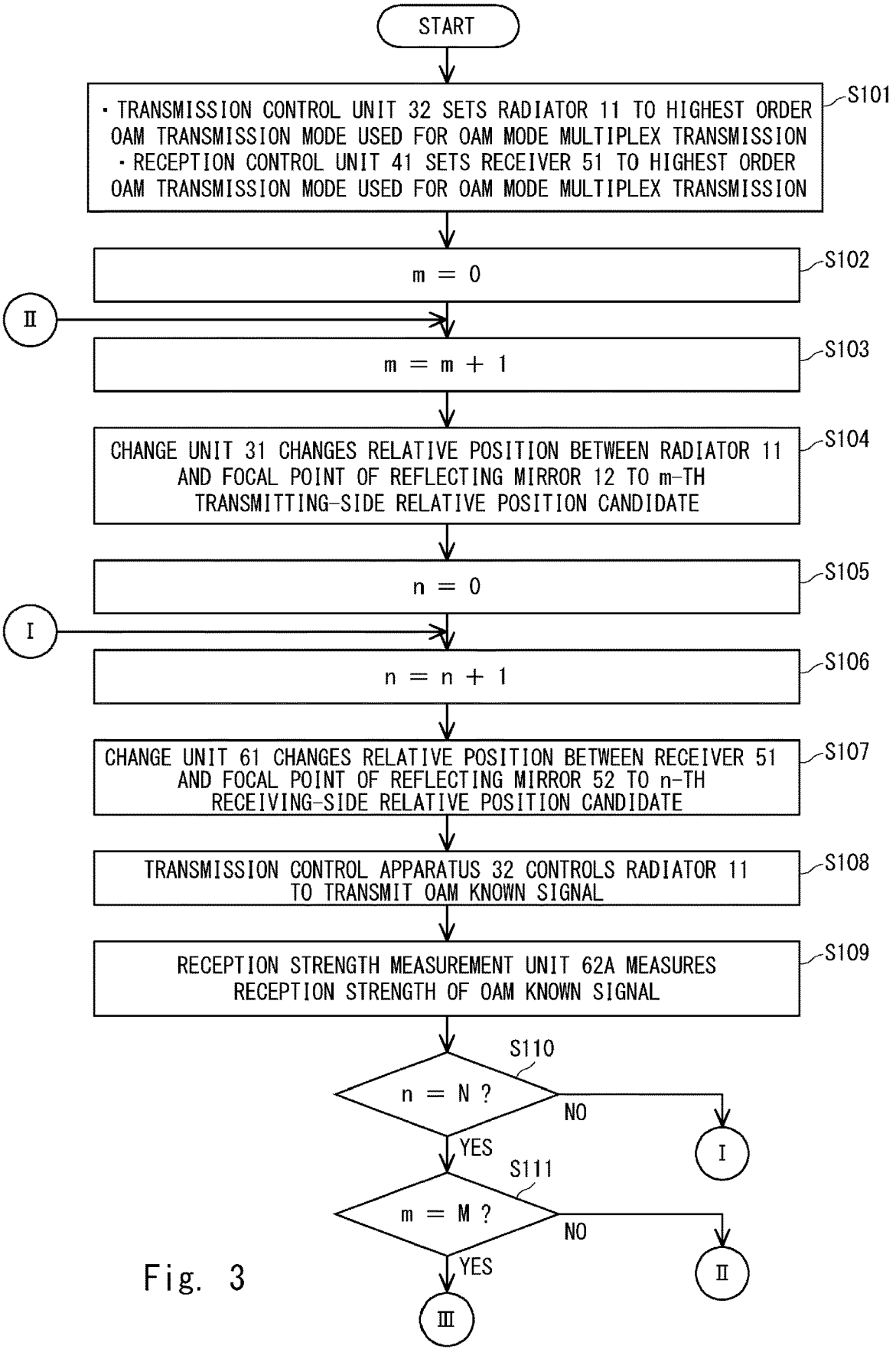
FIG. 3 is a flowchart showing an example of a processing operation of a transmitting-side control apparatus and a receiving-side control apparatus according to the second example embodiment.
Figure 4:
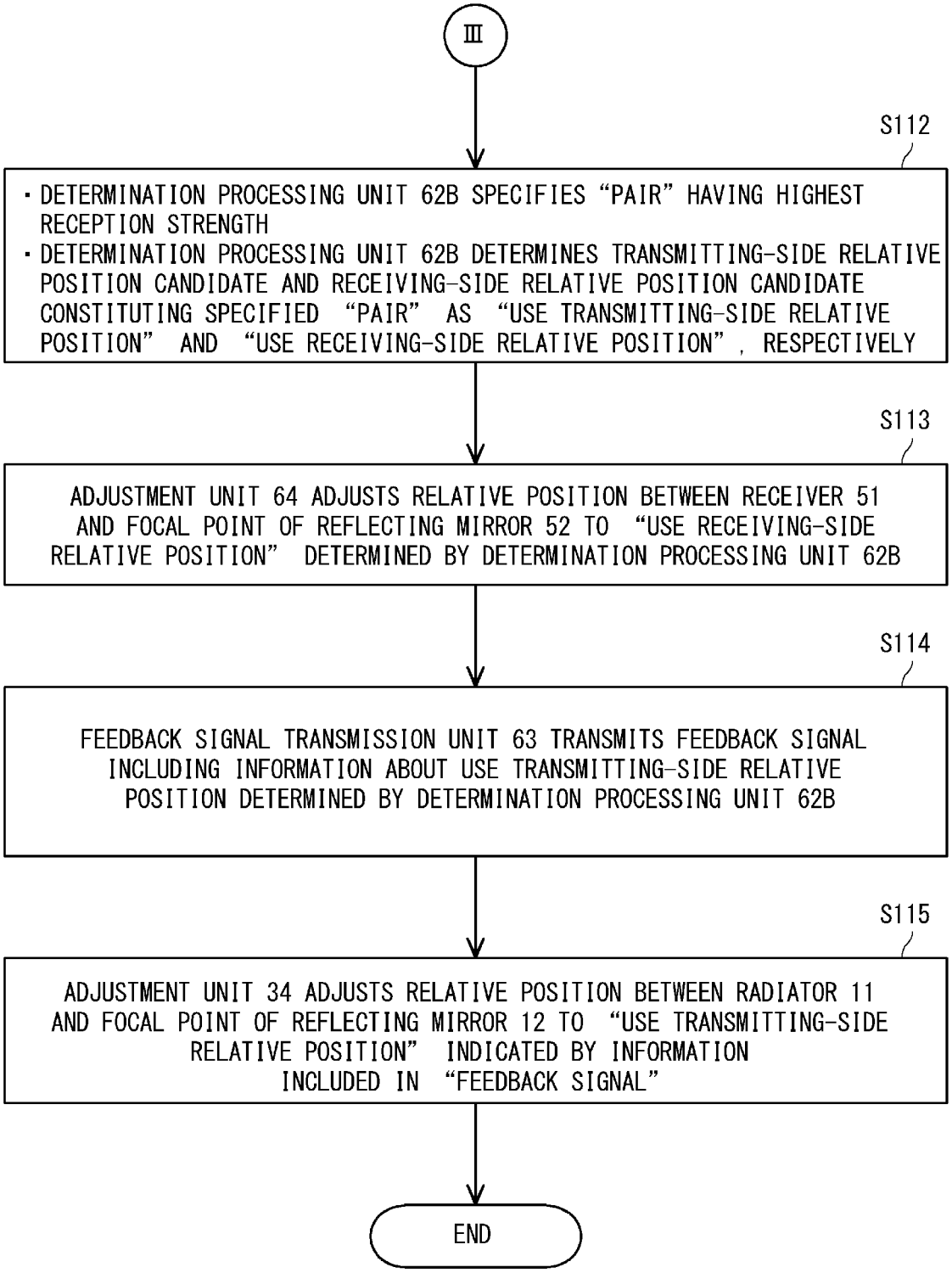
FIG. 4 is a flowchart showing the processing operation after FIG. 3.

An example of the processing operation of the transmitting-side control apparatus 30 and the receiving-side control apparatus 60 according to the second example embodiment having the above configuration will be described. FIG. 3 is a flowchart showing an example of the processing operation of the transmitting-side control apparatus and the receiving-side control apparatus according to the second example embodiment. FIG. 4 is a flowchart showing the processing operation after FIG. 3. For the sake of convenience, the flowcharts related to the transmitting-side control apparatus and the receiving-side control apparatus are integrated into one.

In the transmitting-side control apparatus 30, the transmission control unit 32 sets the radiator 11 to the highest order (i.e., the order of the mode is the highest) OAM transmission mode used for the OAM mode multiplex transmission (Step S101). In the receiving-side control apparatus 60, the reception control unit 41 sets the receiver 51 to the highest order (i.e., the order of the mode is the highest) OAM transmission mode used for the OAM mode multiplex transmission (Step S101).

In the transmitting-side control apparatus 30, the change unit 31 initializes a value of m, which is a number of the transmitting-side relative position candidate, to "zero" (Step S102), and increments the value of m (Step S103). Here, it is assumed that there are a total of M (M is a natural number greater than or equal to 2) transmitting-side relative position candidates.

In the transmitting-side control apparatus 30, the change unit 31 changes the relative position between the radiator 11 and the focal point of the reflecting mirror 12 to the m-th transmitting-side relative position candidate (Step S104).

In the receiving-side control apparatus 60, the change unit 61 initializes a value of n, which is a number of the receiving-side relative position candidate, to "zero" (Step S105), and increments the value of n (Step S106).

In the receiving-side control apparatus 60, the change unit 61 changes the relative position between the receiver 51 and the focal point of the reflecting mirror 52 to the n-th receiving-side relative position candidate (Step S107). Here, it is assumed that there are a total of N receiving-side relative position candidates (N is a natural number greater than or equal to 2).

In the transmitting-side control apparatus 30, the transmission control unit 32 controls the radiator 11 to transmit the OAM known signal (Step S108).

In the receiving-side control apparatus 60, the reception strength measurement unit 62A measures the reception strength of the OAM known signal (Step S109).

In the receiving-side control apparatus 60, the change unit 61 determines whether the value of n has reached N (Step S110).

If the value of n has not reached N (Step S110: NO), the processing step returns to Step S106.

If the value of n has reached N (Step S110: YES), in the transmitting-side control apparatus 30, the change unit 31 determines whether the value of m has reached M (Step S111).

If the value of m has not reached M (Step S111: NO), the processing step returns to Step S103.

If the value of m has reached M (Step S111: YES), in the receiving-side control apparatus 60, the determination processing unit 62B specifies the "pair" having the highest reception strength (Step S112). Then, the determination processing unit 62B determines the transmitting-side relative position candidate and the receiving-side relative position candidate constituting the specified "pair" as the "use transmitting-side relative position" and the "use receiving-side relative position", respectively (Step S112).

In the receiving-side control apparatus 60, the adjustment unit 64 adjusts the relative position between the receiver 51 and the focal point of the reflecting mirror 52 to the "use receiving-side relative position" determined by the determination processing unit 62B (Step S113).

In the receiving-side control apparatus 60, the feedback signal transmission unit 63 transmits the feedback signal including information about the use transmitting-side relative position determined by the determination processing unit 62B (Step S114).

In the transmitting-side control apparatus 30, the adjustment unit 34 adjusts the relative position between the radiator 11 and the focal point of the reflecting mirror 12 to the "use transmitting-side relative position" indicated by the information included in the "feedback signal" (Step S115). As described above, after the relative position between the radiator 11 and the focal point of the reflecting mirror 12 and the relative position between the receiver 51 and the focal point of the reflecting mirror 52 are adjusted, the "OAM mode multiplexed radio signal" is transmitted and received.

As described above, according to the second example embodiment, in the receiving-side control apparatus 60, while the OAM known signal is being transmitted at each "transmitting-side relative position candidate", the change unit 61 sequentially changes the relative position between the receiver 51 and the focal point F2 of the reflecting mirror 52 among the "plurality of receiving-side relative position candidates". The determination unit 62 determines, as the use transmitting-side relative position and the use receiving-side relative position, the transmitting-side relative position candidate and the receiving-side relative position candidate, respectively, which constitute a pair corresponding to the maximum reception strength among the plurality of reception strengths measured for the plurality of OAM known signals received by the receiver 51. The plurality of OAM known signals received by the receiver 51 correspond to the plurality of "pairs", respectively.

With such a configuration of the receiving-side control apparatus 60, the relative position between the radiator 11 and the focal point of the reflecting mirror 12 and the relative position between the receiver 51 and the focal point of the reflecting mirror 52 used for the OAM mode multiplex transmission can be adjusted based on the reception strength of the OAM known signal transmitted by each "pair". Thus, the transmission efficiency of the OAM transmission can be further improved.

In the above description, although the reception strength is used as an index for determining the "use transmitting-side relative position" and the "use receiving-side relative position", this is an example of an "index of reception quality" and is not limited to this.

Third Example Embodiment

A third example embodiment relates to an example embodiment in which a relative position between a radiator and a focal point of a reflecting mirror is not changed in an OAM transmission apparatus, and instead a relative position between a receiver and the focal point of the reflecting mirror is changed in an OAM reception apparatus.

<Overview of Communication System>

Figure 5:
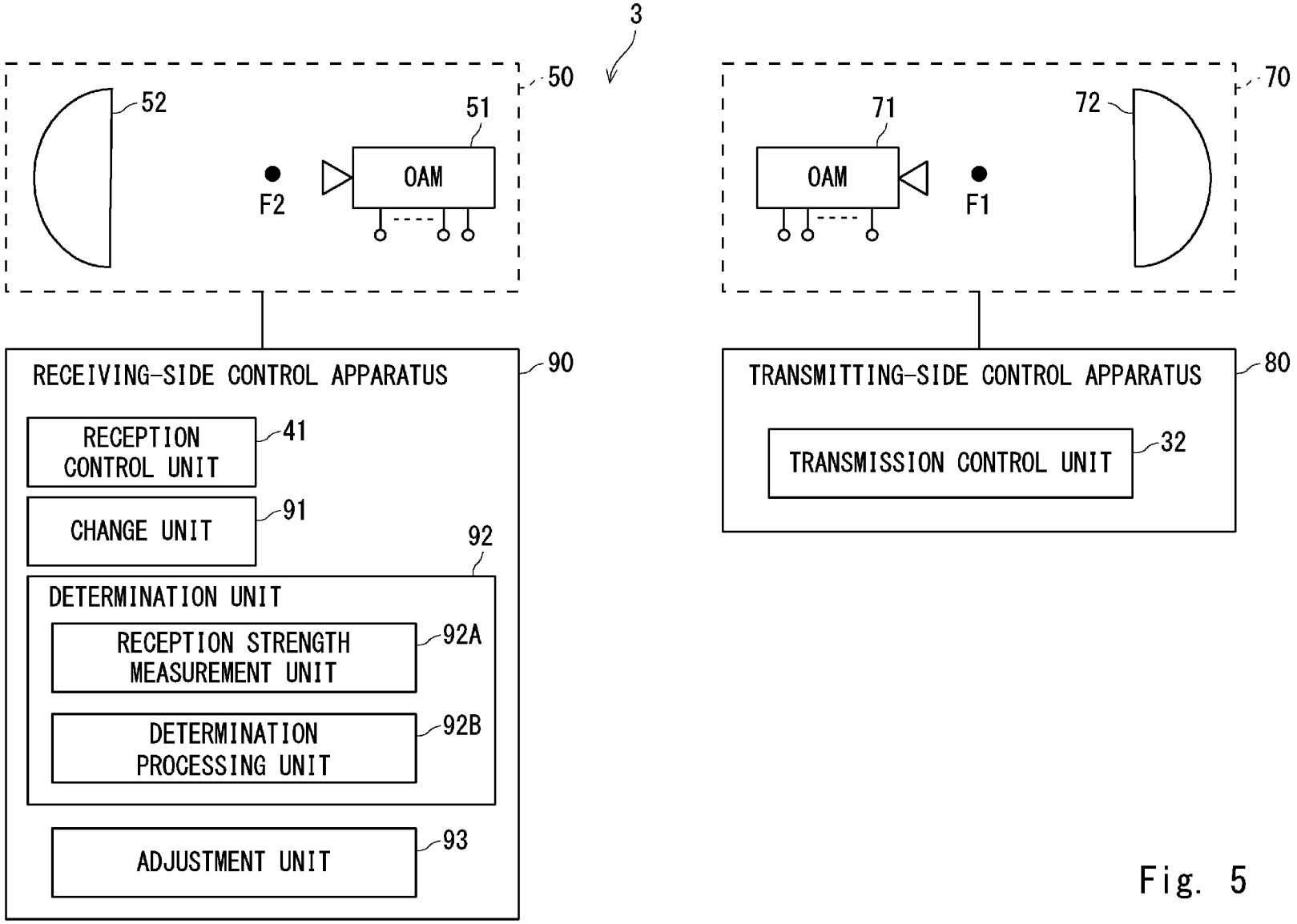
FIG. 5 shows an example of a communication system according to a third example embodiment.

FIG. 5 shows an example of a communication system according to the third example embodiment. In FIG. 5, the communication system 3 includes an OAM transmission apparatus 70, a transmitting-side control apparatus 80, an OAM reception apparatus 50, and a receiving-side control apparatus 90.

The OAM transmission apparatus 70 is configured to be able to transmit, as an OAM radio signal, an "OAM mode multiplexed radio signal" obtained by multiplexing a plurality of data signals corresponding to a plurality of OAM transmission modes, respectively. The OAM transmission apparatus 70 is configured to be able to also transmit, as an OAM radio signal", "OAM known signal" formed by one OAM transmission mode.

For example, the OAM transmission apparatus 70 includes a radiator 71 and a reflecting mirror (a transmitting-side reflecting mirror) 72. The radiator 71 emits the OAM radio signal toward the reflecting mirror 72. The reflecting mirror 72 reflects the OAM radio signal emitted from the radiator 71. The reflected OAM radio signal propagates in the direction in which the OAM reception apparatus 50 is located.

The transmitting-side control apparatus 80 and the receiving-side control apparatus 90 adjust the relative positional relationship between the receiver 51 and the focal point of the reflecting mirror 52. Details will be described later.

<Configuration Example of Transmitting-Side Control Apparatus>

As shown in FIG. 5, the transmitting-side control apparatus 30 includes the transmission control unit 32. The transmission control unit 32 controls the radiator 11 to transmit the "OAM known signal" formed by the "one common OAM transmission mode" at each of the "transmitting-side relative position candidates". The "one common OAM transmission mode" is an (highest order) OAM transmission mode having the highest order of a mode among the plurality of OAM transmission modes used when the "OAM mode multiplexed radio signal" is formed.

<Configuration Example of Receiving-Side Control Apparatus>

As shown in FIG. 5, the receiving-side control apparatus 90 includes the reception control unit 41, a change unit 91, a determination unit 92, and an adjustment unit 93.

In a manner similar to the first example embodiment, the reception control unit 41 according to the third example embodiment controls the receiver 51 to receive, in the OAM reception mode corresponding to the one OAM transmission mode, the OAM known signal transmitted from the OAM transmission apparatus 10 using the one OAM transmission mode.

While the OAM known signal is being transmitted from the OAM transmission apparatus 70, the change unit 91 sequentially changes the relative position between the receiver 51 and the focal point F2 of the reflecting mirror 52 among the "plurality of receiving-side relative position candidates". The "plurality of receiving-side relative position candidates" include a plurality of relative positions between the receiver 51 and the focal point of the reflecting mirror 52, in which the plurality of relative positions have relative relationships different from each other on a straight line connecting a central point of the reflecting mirror 52 to the focal point of the reflecting mirror 52. Further, the "plurality of receiving-side relative position candidates" may include a plurality of relative positions between the receiver 51 and the focal point of the reflecting mirror 52, in which the plurality of relative positions have relative relationships different from each other in a direction parallel to a plane orthogonal to the straight line connecting the central point of the reflecting mirror 52 to the focal point of the reflecting mirror 52.

The determination unit 92 determines, as the "use receiving-side relative position", the receiving-side relative position candidate corresponding to the maximum reception strength among the plurality of reception strengths measured for the plurality of OAM known signals received by the receiver 51.

For example, the determination unit 92 includes a reception strength measurement unit 92A and a determination processing unit 92B. The reception strength measurement unit 92A measures the reception strength of the OAM known signal received by the receiver 51. The determination processing unit 92B determines, as the "use receiving-side relative position", the receiving-side relative position candidate corresponding to the maximum reception strength among the plurality of reception strengths measured by the reception strength measurement unit 92A.

The adjustment unit 93 adjusts the relative position between the receiver 51 and the focal point F2 of the reflecting mirror 52 to the "use receiving-side relative position" determined by the determination unit 92.

As described above, according to the third embodiment, in the receiving-side control apparatus 90, while the OAM known signal is being transmitted from the OAM transmission apparatus 70, the change unit 91 sequentially changes the relative position between the receiver 51 and the focal point F2 of the reflecting mirror 52 among the "plurality of receiving-side relative position candidates". The reception control unit 41 controls the receiver 51 to receive, in the OAM reception mode corresponding to the one OAM transmission mode, the OAM known signal transmitted from the OAM transmission apparatus 70 using the one OAM transmission mode. The determination unit 92 determines, as the "use receiving-side relative position", the receiving-side relative position candidate corresponding to the maximum reception strength among the plurality of reception strengths measured for the plurality of OAM known signals received by the receiver 51. The plurality of OAM known signals received by the receiver 51 correspond to the plurality of receiving-side relative position candidates, respectively.

With such a configuration of the receiving-side control apparatus 90, the relative position between the receiver 51 and the focal point of the reflecting mirror 52 used for the OAM mode multiplex transmission can be adjusted based on the reception strength of the OAM known signal received at each receiving-side relative position candidate. Thus, the transmission efficiency of OAM transmission can be further improved.

In the above description, although the reception strength is used as an index for determining the "use receiving-side relative position", this is an example of an "index of reception quality" and is not limited to this.

Other Example Embodiments

<1> In the first to third example embodiments, although the OAM transmission apparatus and the transmitting-side control apparatus have been described as separate apparatuses, the present disclosure is not limited to this. Alternatively, the transmitting-side control apparatus may be included in the OAM transmission apparatus. Further, in the first to third example embodiments, although the OAM reception apparatus and the receiving-side control apparatus have been described as separate apparatuses, the present disclosure is not limited to this. Alternatively, the receiving-side control apparatus may be included in the OAM reception apparatus.

<2> The transmitting-side control apparatus and the receiving-side control apparatus described in the first to third example embodiments may constitute a control system.

Figure 6:
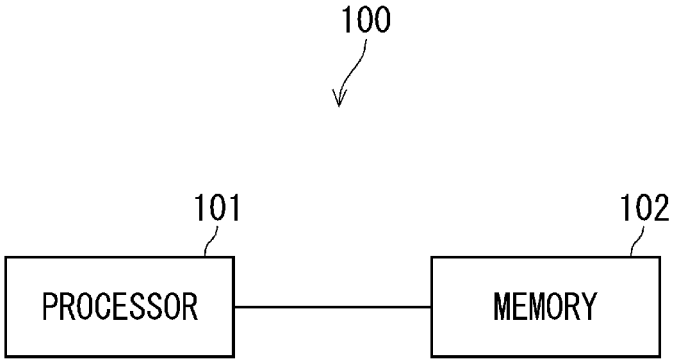
FIG. 6 shows an example of a hardware configuration of a control apparatus.

<3> FIG. 6 shows an example of a hardware configuration of the control apparatus. Each of the transmitting-side control apparatuses 30 and 80 and the receiving-side control apparatuses 40, 60, and 90 according to the first to third example embodiments may have a hardware configuration shown in FIG. 6. The change unit 31, the transmission control unit 32, the acquisition unit 33, and the adjustment unit 34 of the transmitting-side control apparatuses 30 and 80 according to the first to the third example embodiments may be implemented by a processor 101 reading and executing programs stored in the memory 102. Further, the reception control units 41, the determination units 42, 62, and 92, the feedback signal transmission units 43 and 63, the change units 61 and 91, and the adjustment units 64 and 93 of the receiving-side control apparatuses 40, 60, and 90 may be implemented by the processor 101 reading and executing programs stored in the memory 102. The programs can be stored and provided to the transmitting-side control apparatuses 30 and 80 and the receiving-side control apparatuses 40, 60, and 90 using any type of non-transitory computer readable media. Further, the programs may be provided to the transmitting-side control apparatuses 30 and 80 and the receiving-side control apparatuses 40, 60, and 90 using any type of transitory computer readable media.

Although the present disclosure has been described above with reference to the example embodiments, the present disclosure is not limited by the above. Various modifications that can be understood by those skilled in the art within the scope of the disclosure can be made to the configuration and details of the present disclosure.

The whole or part of the exemplary embodiments disclosed above can be described as, but not limited to, the following supplementary notes.

(Supplementary Note 1)

A control apparatus for controlling an Orbitral Angular Momentum (OAM) transmission apparatus including a radiator configured to be able to emit an OAM radio signal and a transmitting-side reflecting mirror configured to reflect the OAM radio signal emitted from the radiator toward an OAM reception apparatus, the control apparatus comprising:

a change unit configured to sequentially change a relative position between the radiator and a focal point of the transmitting-side reflecting mirror among a plurality of transmitting-side relative position candidates;

a transmission control unit configured to control the radiator to transmit an OAM known signal formed by one common OAM transmission mode at each of the plurality of transmitting-side relative position candidates;

an acquisition unit configured to acquire a feedback signal including information about a use transmitting-side relative position based on a reception quality of the OAM known signal transmitted under the control of the transmission control unit; and an adjustment unit configured to adjust the relative position between the radiator and the focal point of the transmitting-side reflecting mirror to the use transmitting-side relative position indicated by the information included in the feedback signal.

(Supplementary Note 2)

The control apparatus according to Supplementary note 1, wherein the OAM transmission apparatus is configured to be able to transmit an OAM mode multiplexed radio signal obtained by multiplexing a plurality of data signals corresponding to a plurality of OAM transmission modes, respectively, and the transmission control unit is configured to set the OAM transmission mode having the highest order of a mode among the plurality of OAM transmission modes as the one common OAM transmission mode.

(Supplementary Note 3)

The control apparatus according to Supplementary note 1 or 2, wherein the plurality of transmitting-side relative position candidates include a plurality of relative positions between the radiator and the focal point of the transmitting-side reflecting mirror, the plurality of relative positions including relative relationships different from each other on a straight line connecting a central point of the transmitting-side reflecting mirror to the focal point of the transmitting-side reflecting mirror and include a plurality of relative positions between the radiator and the transmitting-side reflecting mirror, the plurality of relative positions including relative relationships different from each other in a direction parallel to a plane orthogonal to the straight line.

(Supplementary Note 4)

The control apparatus according to any one of Supplementary notes 1 to 3, wherein the transmitting-side reflecting mirror includes a reflection member configured to electrically vary a position of the focal point, the change unit is configured to change the relative position by executing control to electrically vary the position of the focal point, and the adjustment unit is configured to adjust the relative position by executing control to electrically vary the position of the focal point.

(Supplementary Note 5)

The OAM transmission apparatus comprising the control apparatus according to any one of Supplementary notes 1 to 4.

(Supplementary Note 6)

A control apparatus for controlling an OAM reception apparatus including a receiving-side reflecting mirror and a radio receiver, the receiving-side reflecting mirror being configured to reflect an OAM radio signal emitted from a radiator in an OAM transmission apparatus including the radiator and a transmitting-side reflecting mirror, reflected by the transmitting-side reflecting mirror, and transmitted from the OAM transmission apparatus, and the radio receiver being configured to receive the OAM radio signal reflected by the receiving-side reflecting mirror, the controlling apparatus comprising:

a reception control unit configured to control the radio receiver to receive, in an OAM reception mode corresponding to one common OAM transmission mode, an OAM known signal transmitted from the OAM transmission apparatus at each of transmitting-side relative position candidates between the radiator and a focal point of the transmitting-side reflecting mirror using the one common OAM transmission mode;

a determination unit configured to determine, as a use transmitting-side relative position, the transmitting-side relative position candidate corresponding to a best reception quality among a plurality of reception qualities measured for a plurality of the OAM known signals received by the radio receiver; and a feedback signal transmission unit configured to transmit a feedback signal including information about the determined use transmitting-side relative position.

(Supplementary Note 7)

The control apparatus according to Supplementary note 6, wherein the one common OAM transmission mode is the OAM transmission mode having the highest order of a mode among the plurality of OAM transmission modes.

(Supplementary Note 8)

The control apparatus according to Supplementary note 6 or 7, further comprising:

a change unit configured to sequentially change a relative position between the radio receiver and a focal point of the receiving-side reflecting mirror among a plurality of receiving-side relative position candidates while the OAM known signal is being transmitted at each of the transmitting-side relative position candidates, wherein the determination unit is configured to determine, as the use transmitting-side relative position and a use receiving-side relative position, the receiving-side relative position candidate and the transmitting-side relative position candidate, respectively, which constitute a combination corresponding to a best reception quality among a plurality of reception qualities measured for a plurality of the OAM known signals, the plurality of OAM known signals corresponding to a plurality of the combinations, respectively, each combination including one of the plurality of transmitting-side relative position candidates and one of the plurality of receiving-side relative position candidates, and the plurality of OAM known signals being received by the radio receiver.

(Supplementary Note 9)

The control apparatus according to Supplementary note 8, wherein the receiving-side reflecting mirror includes a reflection member configured to electrically vary a position of the focal point, and the change unit is configured to change the relative position by executing control to electrically vary the position of the focal point.

(Supplementary Note 10)

The control apparatus according to Supplementary note 8 or 9, wherein the plurality of receiving-side relative position candidates include a plurality of the relative positions between the radio receiver and the focal point of the receiving-side reflecting mirror, the plurality of relative positions including relative relationships different from each other on a straight line connecting a central point of the receiving-side reflecting mirror to the focal point of the receiving-side reflecting mirror and include a plurality of relative positions between the radio receiver and the focal point of the receiving-side reflecting mirror, the plurality of relative positions including relative relationships different from each other in a direction parallel to a plane orthogonal to the straight line.

(Supplementary Note 11)

The OAM reception apparatus comprising the control apparatus according to any one of Supplementary notes 6 to 10.

(Supplementary Note 12)

A control method for adjusting a relative position between a radiator and a focal point of a transmitting-side reflecting mirror in an OAM transmission apparatus including the radiator configured to be able to emit an OAM radio signal and the transmitting-side reflecting mirror configured to reflect the OAM radio signal emitted from the radiator toward an OAM reception apparatus, the control method comprising:

sequentially changing a relative position between the radiator and a focal point of the transmitting-side reflecting mirror among a plurality of transmitting-side relative position candidates;

controlling the radiator to transmit an OAM known signal formed by one common OAM transmission mode at each of the plurality of transmitting-side relative position candidates;

acquiring a feedback signal including information about a use transmitting-side relative position based on a reception quality of the transmitted OAM radio signal; and adjusting the relative position between the radiator and the focal point of the transmitting-side reflecting mirror to the use transmitting-side relative position indicated by the information included in the feedback signal.

(Supplementary Note 13)

A control method for adjusting a relative position between a radiator and a focal point of a transmitting-side reflecting mirror in an OAM transmission apparatus including the radiator configured to be able to emit an OAM radio signal and the transmitting-side reflecting mirror configured to reflect the OAM radio signal emitted from the radiator toward an OAM reception apparatus, wherein the OAM reception apparatus comprises a receiving-side reflecting mirror and a radio receiver, the receiving-side reflecting mirror being configured to reflect the OAM radio signal transmitted from the OAM transmission apparatus, and the radio receiver being configured to receive the OAM radio signal reflected by the receiving-side reflecting mirror, the control method comprising:

controlling the radio receiver to receive, in an OAM reception mode corresponding to one common OAM transmission mode, an OAM known signal transmitted from the OAM transmission apparatus at each of transmitting-side relative position candidates between the radiator and a focal point of the transmitting-side reflecting mirror using the one common OAM transmission mode;

determining, as a use transmitting-side relative position, the transmitting-side relative position candidate corresponding to a best reception quality among a plurality of reception qualities measured for a plurality of the OAM known signals received by the radio receiver; and transmitting a feedback signal including information about the determined use transmitting-side relative position.

(Supplementary Note 14)

A control program for controlling a control apparatus for controlling an OAM transmission apparatus including a radiator configured to be able to emit an OAM radio signal and a transmitting-side reflecting mirror configured to reflect the OAM radio signal emitted from the radiator toward an OAM reception apparatus to execute processing of:

sequentially changing a relative position between the radiator and a focal point of the transmitting-side reflecting mirror among a plurality of transmitting-side relative position candidates;

controlling the radiator to transmit an OAM known signal formed by one common OAM transmission mode at each of the plurality of transmitting-side relative position candidates;

acquiring a feedback signal including information about a use transmitting-side relative position based on a reception quality of the transmitted OAM known signal; and adjusting the relative position between the radiator and the focal point of the transmitting-side reflecting mirror to the use transmitting-side relative position indicated by the information included in the feedback signal.

(Supplementary Note 15)

A control program for causing a control apparatus for controlling an OAM reception apparatus including a receiving-side reflecting mirror and a radio receiver, the receiving-side reflecting mirror being configured to reflect an OAM radio signal emitted from a radiator in an OAM transmission apparatus including the radiator and a transmitting-side reflecting mirror, reflected by the transmitting-side reflecting mirror, and transmitted from the OAM transmission apparatus, and the radio receiver being configured to receive the OAM radio signal reflected by the receiving-side reflecting mirror, to execute processing of:

controlling the radio receiver to receive, in an OAM reception mode corresponding to one common OAM transmission mode, an OAM known signal transmitted from the OAM transmission apparatus at each of transmitting-side relative position candidates between the radiator and a focal point of the transmitting-side reflecting mirror using the one common OAM transmission mode;

determining, as a use transmitting-side relative position, the transmitting-side relative position candidate corresponding to a best reception quality among a plurality of reception qualities measured for a plurality of the OAM known signals received by the radio receiver; and transmitting a feedback signal including information about the determined use transmitting-side relative position.

(Supplementary Note 16)

A control system for controlling an OAM transmission apparatus including a radiator configured to be able to emit an OAM radio signal and a transmitting-side reflecting mirror configured to reflect the OAM radio signal emitted from the radiator toward an OAM reception apparatus and an OAM reception apparatus including a receiving-side reflecting mirror configured to reflect the OAM radio signal reflected by the transmitting-side reflecting mirror and a radio receiver configured to receive the OAM radio signal reflected by the receiving-side reflecting mirror, the control system comprising:

a first change unit configured to sequentially change a relative position between the radiator and a focal point of the transmitting-side reflecting mirror among a plurality of transmitting-side relative position candidates;

a transmission control unit configured to control the radiator to transmit an OAM known signal formed by one common OAM transmission mode at each of the plurality of transmitting-side relative position candidates;

a second change unit configured to sequentially change a relative position between the radio receiver and a focal point of the receiving-side reflecting mirror among a plurality of receiving-side relative position candidates while the OAM known signal is being transmitted from the radiator at each of the transmitting-side relative position candidates;

a reception control unit configured to control the radio receiver to receive the transmitted OAM known signal in an OAM reception mode corresponding to the one common OAM transmission mode;

a determination unit configured to determine, as a use transmitting-side relative position and a use receiving-side relative position, the receiving-side relative position candidate and the transmitting-side relative position candidate, respectively, which constitute a combination corresponding to a best reception quality among a plurality of reception qualities, a plurality of the OAM known signals corresponding to a plurality of the combinations, each combination including one of the plurality of transmitting-side relative position candidates and one of the plurality of receiving-side relative position candidates, and the plurality of OAM known signals being received by the radio receiver;

a first adjustment unit configured to adjust the relative position between the radiator and the focal point of the transmitting-side reflecting mirror to the use transmitting-side relative position; and a second adjustment unit configured to adjust the relative position between the radio receiver and the focal position of the receiving-side reflecting mirror to the use receiving-side relative position.

(Supplementary Note 17)

A control apparatus for controlling an OAM reception apparatus including a receiving-side reflecting mirror and a radio receiver, the receiving-side reflecting mirror being configured to reflect an OAM radio signal emitted from a radiator in an OAM transmission apparatus including the radiator and a transmitting-side reflecting mirror, reflected by the transmitting-side reflecting mirror, and transmitted from the OAM transmission apparatus, and the radio receiver being configured to receive the OAM radio signal reflected by the receiving-side reflecting mirror, the control apparatus comprising:

a change unit configured to sequentially change a relative position between the radio receiver and a focal point of the receiving-side reflecting mirror among a plurality of receiving-side relative position candidates;

a reception control unit configured to control the radio receiver to receive an OAM known signal transmitted using one OAM transmission mode from the OAM transmission apparatus in an OAM reception mode corresponding to the one OAM transmission mode at each of the receiving-side relative position candidates; and a determination unit configured to determine, as a use receiving-side relative position, the receiving-side relative position candidate corresponding to a best reception quality among a plurality of reception qualities measured for a plurality of the OAM known signals received by the radio receiver at the plurality of receiving-side relative position candidates.

(Supplementary Note 18)

The control apparatus according to Supplementary note 17, wherein the OAM transmission apparatus is configured to transmit an OAM mode multiplexed radio signal obtained by multiplexing a plurality of data signals corresponding to a plurality of OAM transmission modes, respectively, and the one OAM transmission mode is the OAM transmission mode having the highest order of a mode among the plurality of OAM transmission modes.

(Supplementary Note 19)

The control apparatus according to Supplementary note 17 or 18, wherein the OAM transmission apparatus is configured to transmit the OAM known signal at each of the plurality of transmitting-side relative position candidates between the radiator and a focal point of the transmitting-side reflecting mirror, the change unit sequentially changes the relative position between the radio receiver and the focal point of the receiving-side reflecting mirror among the plurality of receiving-side relative position candidates while the OAM known signal is being transmitted at each of the transmitting-side relative position candidates, and the determination unit determines, as a use transmitting-side relative position and the use receiving-side relative position, the receiving-side relative position candidate and the transmitting-side relative position candidate, respectively, which constitute a combination corresponding to a best reception quality among a plurality of reception qualities, the plurality of OAM known signals corresponding to a plurality of the combinations, respectively, each combination including one of the plurality of transmitting-side relative position candidates and one of the plurality of receiving-side relative position candidates, and the plurality of OAM known signals being received by the radio receiver.

(Supplementary Note 20)

The control apparatus according to Supplementary note 19, further comprising:

a feedback signal transmission unit configured to transmit a feedback signal including information about the determined use transmitting-side relative position.

(Supplementary Note 21)

The control apparatus according to any one of Supplementary notes 17 to 20, wherein the plurality of receiving-side relative position candidates include a plurality of the relative positions between the radio receiver and the focal point of the transmitting-side reflecting mirror, the plurality of relative positions including relative relationships different from each other on a straight line connecting a central point of the receiving-side reflecting mirror to the focal point of the receiving-side reflecting mirror and include a plurality of relative positions between the radio receiver and the focal point of the receiving-side reflecting mirror, the plurality of relative positions including relative relationships different from each other in a direction parallel to a plane orthogonal to the straight line.

(Supplementary Note 22)

The control apparatus according to any one of Supplementary notes 17 to 21, wherein the receiving-side reflecting mirror includes a reflection member configured to electrically vary a position of the focal point, and the change unit is configured to change the relative position by executing control to electrically vary the position of the focal point.

(Supplementary Note 23)

The OAM reception apparatus comprising the control apparatus according to any one of Supplementary notes 17 to 22.

This application is based upon and claims the benefit of priority from Japanese patent application No. 2018-146300, filed on Aug. 2, 2018, the disclosure of which is incorporated herein in its entirety by reference.

REFERENCE SIGNS LIST

1, 2, 3 COMMUNICATION SYSTEM
10, 70 OAM TRANSMISSION APPARATUS
11, 71 RADIATOR
12, 72 REFLECTING MIRROR (TRANSMITTING-SIDE REFLECTING MIRROR)
20, 50 OAM RECEPTION APPARATUS
21, 51 RECEIVER (RADIO RECEIVER)
22, 52 REFLECTING MIRROR (RECEIVING-SIDE REFLECTING MIRROR)
30, 80 TRANSMITTING-SIDE CONTROL APPARATUS
31, 61 CHANGE UNIT
32 TRANSMISSION CONTROL UNIT
33 ACQUISITION UNIT
34 ADJUSTMENT UNIT
40, 60, 90 RECEIVING-SIDE CONTROL UNIT
41 RECEPTION CONTROL UNIT
42, 62, 92 DETERMINATION UNIT
42A, 62A, 92A RECEPTION STRENGTH MEASUREMENT UNIT
42B, 62B, 92B DETERMINATION PROCESSING UNIT
43, 63 FEEDBACK SIGNAL TRANSMISSION UNIT
61, 91 CHANGE UNIT
93 ADJUSTMENT UNIT

What is claimed is:

1. A control apparatus for controlling an Orbital Angular Momentum (OAM) transmission apparatus including a radiator configured to be able to emit an OAM radio signal and a transmitting-side reflecting mirror configured to reflect the OAM radio signal emitted from the radiator toward an OAM reception apparatus, the control apparatus comprising:

hardware including at least one processor and at least one memory;

a changing unit implemented at least by the hardware and that sequentially changes a relative position between the radiator and a focal point of the transmitting-side reflecting mirror among a plurality of transmitting-side relative position candidates;

a transmission control unit implemented at least by the hardware and that controls the radiator to transmit an OAM known signal formed by one common OAM transmission mode at each of the plurality of transmitting-side relative position candidates;

an acquisition unit implemented at least by the hardware and that acquires a feedback signal including information about a use transmitting-side relative position based on a reception quality of the OAM known signal transmitted under the control of the transmission control unit; and an adjustment unit implemented at least by the hardware and that adjusts the relative position between the radiator and the focal point of the transmitting-side reflecting mirror to the use transmitting-side relative position indicated by the information included in the feedback signal.

2. The control apparatus according to claim 1, wherein the OAM transmission apparatus is configured to be able to transmit an OAM mode multiplexed radio signal obtained by multiplexing a plurality of data signals corresponding to a plurality of OAM transmission modes, respectively, and the transmission control unit is configured to set the OAM transmission mode having the highest order of a mode among the plurality of OAM transmission modes as the one common OAM transmission mode.

3. The control apparatus according to claim 1, wherein the plurality of transmitting-side relative position candidates include a plurality of relative positions between the radiator and the focal point of the transmitting-side reflecting mirror, the plurality of relative positions including relative relationships different from each other on a straight line connecting a central point of the transmitting-side reflecting mirror to the focal point of the transmitting-side reflecting mirror and include a plurality of relative positions between the radiator and the transmitting-side reflecting mirror, the plurality of relative positions including relative relationships different from each other in a direction parallel to a plane orthogonal to the straight line.

4. The control apparatus according to claim 1, wherein the transmitting-side reflecting mirror includes a reflection member configured to electrically vary a position of the focal point, the changing unit is configured to change the relative position by executing control to electrically vary the position of the focal point, and the adjustment unit is configured to adjust the relative position by executing control to electrically vary the position of the focal point.

5. The OAM transmission apparatus comprising the control apparatus according to claim 1.

6. A control method for adjusting a relative position between a radiator and a focal point of a transmitting-side reflecting mirror in an OAM transmission apparatus including the radiator configured to be able to emit an OAM radio signal and the transmitting-side reflecting mirror configured to reflect the OAM radio signal emitted from the radiator toward an OAM reception apparatus, the control method comprising:

sequentially changing a relative position between the radiator and a focal point of the transmitting-side reflecting mirror among a plurality of transmitting-side relative position candidates;

controlling the radiator to transmit an OAM known signal formed by one common OAM transmission mode at each of the plurality of transmitting-side relative position candidates;

acquiring a feedback signal including information about a use transmitting-side relative position based on a reception quality of the transmitted OAM radio signal; and adjusting the relative position between the radiator and the focal point of the transmitting-side reflecting mirror to the use transmitting-side relative position indicated by the information included in the feedback signal.

* * * * *